United States Patent [19]

Allmer

[11] 4,092,903

[45] June 6, 1978

[54] VIBRATORY DRIVE MECHANISM

[75] Inventor: Franz Allmer, Sophia, N.C.

[73] Assignee: Graystone Corporation, Monroeville, Pa.

[21] Appl. No.: 632,710

[22] Filed: Nov. 17, 1975

[51] Int. Cl.[2] ..... F15B 21/02

[52] U.S. Cl. ..... 91/36; 91/39; 91/470; 104/12; 137/624.13; 137/625.23; 13/625.47

[58] Field of Search ..... 91/36, 39, 470, 35, 91/456; 137/625.22, 625.47, 624.13, 625.23; 104/7 R, 7 A, 7 B, 8, 10, 11, 12, 13

[56] References Cited

U.S. PATENT DOCUMENTS

| | | | |
|---|---|---|---|
| 225,749 | 3/1880 | Eberman | 137/625.47 |
| 1,006,228 | 10/1911 | Kirkus | 91/39 |
| 2,830,563 | 4/1958 | Burckhalter | 91/470 |
| 3,022,738 | 2/1962 | Krute | 91/39 |
| 3,135,223 | 6/1964 | Plasser | 104/12 |
| 3,192,914 | 7/1965 | Kopczyk | 91/470 |
| 3,211,064 | 10/1965 | Plasser | 104/12 |
| 3,369,459 | 2/1968 | Fisher | 91/39 |
| 3,405,601 | 10/1968 | Clarke | 91/470 |
| 3,430,653 | 3/1969 | Brimhall | 137/625.23 |
| 3,810,417 | 5/1974 | Sieke | 91/39 |
| 3,885,883 | 5/1975 | Sieke | 404/72 |
| 3,995,530 | 12/1976 | Gunn | 91/470 |

*Primary Examiner*—Martin P. Schwadron
*Assistant Examiner*—Abraham Hershkovitz
*Attorney, Agent, or Firm*—Lane, Aitken, Dunner & Ziems

[57] ABSTRACT

Opposed pivotally mounted tamper arms are oscillated by respective single-acting hyraulic piston assemblies controlled by separate hydraulic duplex rotary distributing valves. Fluid supply and return lines for each piston assembly are connected to a source of pressurized hydraulic fluid via the respective rotary valve. Each valve has a stationary ported shell which receives a rotary cylindrical spool having a pair of axially displaced supply and return throughports which alternately register with supply and return line ports in the shell to open and close the connections between the respective piston assembly and the supply and return lines. While the rotary valves are preferably driven by a common drive unit, the relative phase of the oscillations of the arms can be determined by rotationally offsetting one of the spools with respect to the other by the desired phase angle.

13 Claims, 13 Drawing Figures

VIBRATORY DRIVE MECHANISM

BACKGROUND OF THE INVENTION

The invention relates generally to the field of railroad ballast tampers or track tamping machines and hydraulic systems for producing vibratory motion and more specifically to hydraulic vibrator systems for operating track tamping apparatus.

Prior art track tamping machines of the type to which the present invention relates are exemplified by the machine illustrated in U.S. Pat. No. 3,135,223 to Plasser et al. In this system a pair of pincer-like tamper arms are pivotally mounted on a specially designed railroad car having suitable hydraulic systems to enable the tamper arms to be driven sharply into the ballast on either side of the end of a railroad tie. The upper ends of the tamper arms are coupled by a yoke to an eccentric shaft. Rotation of the eccentric shaft imparts vibratory motion to the lower ends of the tamper arms thus assisting in consolidating the ballast. The ends of the tamper arms extend downwardly into the ballast below the tie and are gradually squeezed together by hydraulic means during the compacting operation. Hydraulic systems for controlling the distance between the two tamper arms are shown in U.S. Pat. Nos. 3,211,064, 3,146,727, 3,372,651, 3,357,366, 3,608,498, 2,872,878, and 3,669,025, all to Plasser et al and 2,791,971 to Schellmann.

As discussed in U.S. Pat. No. 3,135,223, track tamping is normally done in conjunction with a leveling operation. A rail which is found to be too low is jacked up by hydraulic means carried on the railroad car tamper unit while the ballast is compacted to raise the associated railroad tie ends which support the section of the rail. In all of the above systems, the vibration of the tamper is induced by the eccentric mounting rather than by hydraulic piston apparatus. The disadvantages which attend the use of an eccentric vibratory mechanism include the cost of replacement and maintenance of the eccentric mechanism and the overall complexity of the unit. In addition, the eccentric shaft requires a fly wheel which cannot be started and stopped between tamping operations on adjacent ties. Thus even while lifting the tamping arms to move them to the next tamping station, the vibratory motion continues, resulting in unnecessary wear, power consumption and noise pollution.

Hydraulic piston apparatus has been considered before in connection with providing vibratory motion for the tamper arms. In U.S. Pat. No. 2,973,719 to Plasser et al a double-acting hydraulic piston, gated by a hydraulic rotary distributor valve, has a rack which meshes with a pinion on a shaft to oscillate a pair of displaced jaws on the end of the shaft. The rotary valve causes six reciprocations per revolution by using a complicated double manifold arrangement and chordal throughports in the spool within the rotary valve. U.S. Pat. No. 3,735,708 to Plasser et al illustrates the use of a hydraulic piston motor which an automatic flip-flop valve to vibrate the tamping tool. The background of the U.S. Pat. No. 3,735,708 indicates the general disadvantages of using separate coaxially arranged hydraulic cylinders to vibrate tamping tools.

U.S. Pat. No. 2,022,738 to Krute illustrates a highly complicated hydraulic rotary control valve for operating a pump. The rotary valve gates hydraulic fluid to and from duplex double-acting hydraulic pistons to provide uniform output flow velocity from the pump.

SUMMARY OF THE INVENTION

The general object of the invention is to provide vibratory or oscillatory motion to a tool. More specifically, the object of the invention is to provide a simple hydraulic vibratory drive for a pair of opposed pivotally mounted tamping arms.

The objects of the present invention are achieved by employing a hydraulic system including a pair of respective plunger-type single-acting hydraulic pistons to reciprocate the ends of a pair of respective pivotally mounted pincer-type tamper arms. Each single acting piston cylinder has supply and exhaust lines connected to a source of pressurized hydraulic fluid via a respective rotary distributing valve assembly which alternately connects the cylinder with the supply and return lines. The respective rotary valves for a pair of tamper arms are driven in common at the same frequency. Each rotary valve includes a rotating spool having a pair of throughports intersecting the axis of rotation which alternately register with aligned openings formed in the shell within which the spool member rotates. In the preferred embodiment, the aligned openings in the shell for the supply line lie on a diameter which is rotated 90° with respect to the diameter on which the aligned openings in the shell for the return line lie. The relative phase of oscillation of the two tamper arms can be adjusted by rotating one of the spools relative to the other. The cross-sectional shape of the throughports in the spool is designed in several embodiments to determine whether the fluid passage through the valve is gradually or suddenly opened and shut while the spool rotates.

While the invention is described by way of a specific application to track tamping apparatus, those skilled in the art will recognize that the vibratory system employed herein can also have application in other vibratory equipment such as rock crushers, concrete vibrators, road bed consolidators, spike drivers, and other impact or vibratory devices such as cross tie spacers, track aligners, impact wrenches, hammers, and drills.

DESCRIPTION OF THE PREFERRED EMBODIMENTS

Since the present invention is concerned neither with the mobile carriage for the track tamper nor with the means for positioning the track tamper in relation to the end of a railroad tie, these elements have not been fully illustrated in this description of the preferred embodiments since any conventional structure can be used for these purposes in connection with the vibratory drive apparatus of the invention in constructing a fully operable track tamper.

Figure 1:
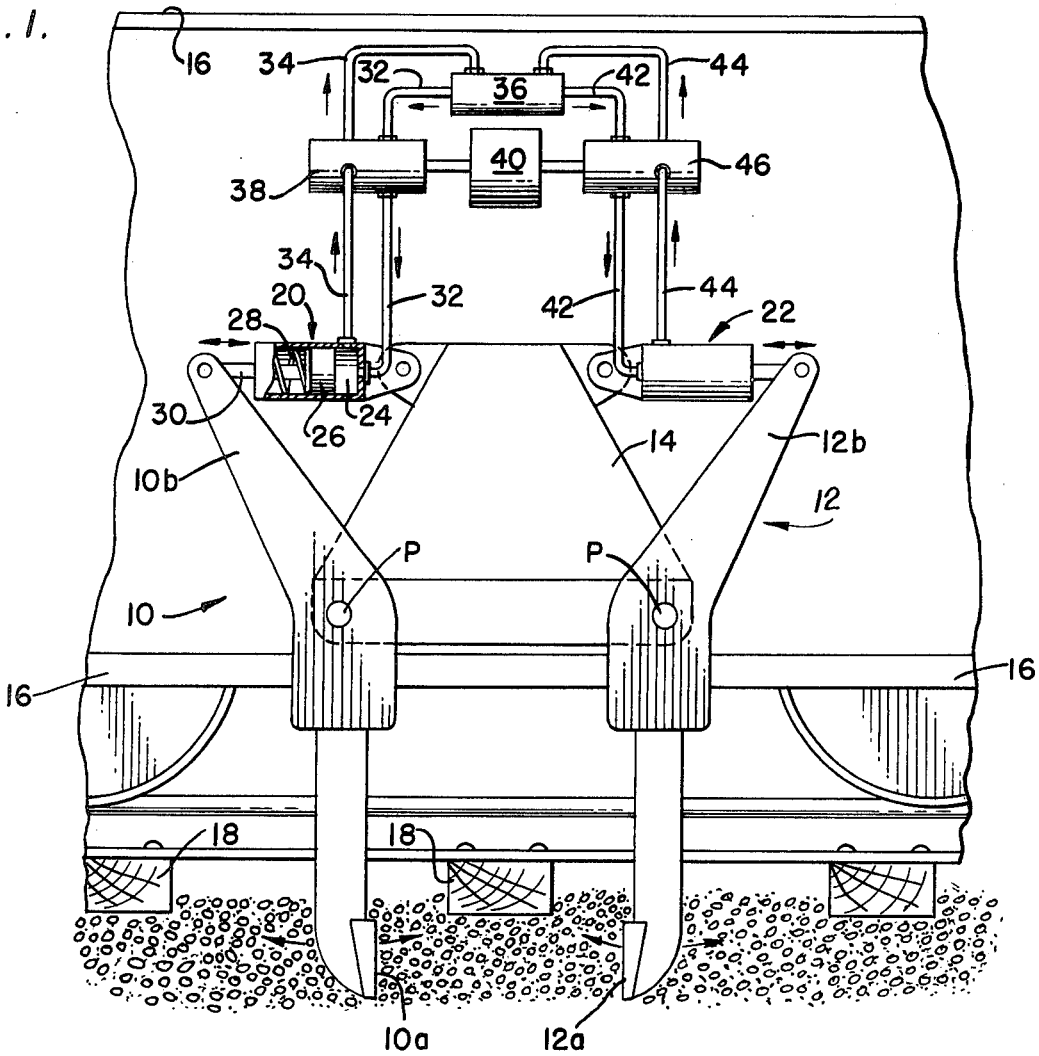
FIG. 1 is a side view in elevation with portions broken away illustrating track tamping apparatus designed according to the invention mounted on a track tamping car unit.
Figure 2:
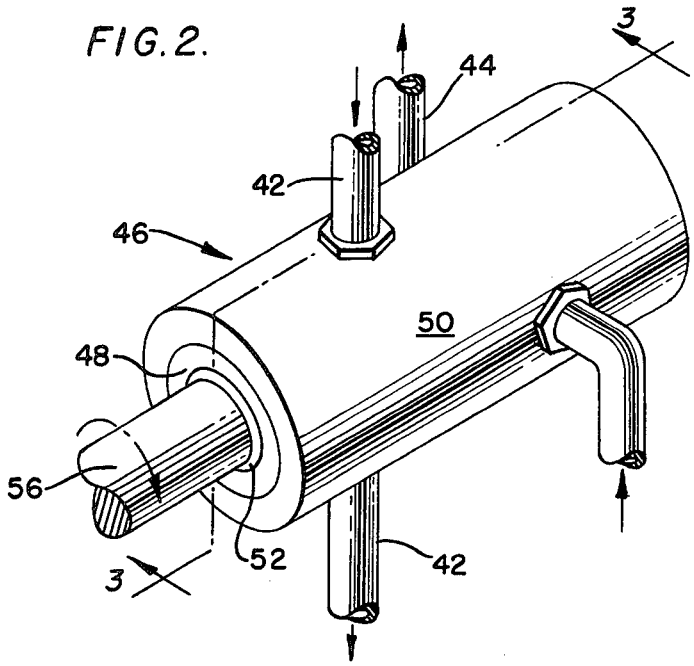
FIG. 2 is an isometric view of the right-hand rotary valve of FIG. 1 in more detail.

FIG. 1 illustrates a pair of opposed tamper arms 10 and 12 pivotally mounted at points P on a support assembly 14 carried on a specially designed railroad car 16. The lower ends 10*a* and 12*a* of the tamper arms 10 and 12 carry tamper blades for compacting the ballast beneath a given railroad tie 18. The upper ends 10*b* and 12*b* of the tamper arms 10 and 12 are pivotally connected to identical plunger-type single-acting hydraulic piston assemblies 20 and 22, respectively, operatively connected between the upper ends 10*b*, 12*b* of the respective tamper arms and the structural support assembly 14.

In a practical embodiment, the support assembly 14 would be specifically equipped with hydraulic means for drawing the pivotal points P of the two tamper arms 10 and 12 together to produce a squeezing action for further compacting the ballast while the tamper arms are being vibrated by the hydraulic piston assemblies 20 and 22.

The piston assembly 20, like the piston assembly 22, is operated by pressurized fluid (typically oil) in a chamber 24 acting on the piston 26 against the bias force of a compression spring 28 or an equivalent compliant element. When the chamber 24 receives pressurized fluid, the piston 26 is driven leftward carrying with it the output shaft 30 which is pivotally connected to the end 10*b* of the tamper arm 10. Hydraulic fluid is supplied to and exhausted from the chamber 24 by means of a fluid supply line 32 connected through an open port at the rear of the chamber 24 and a fluid return line 34 connected through an open port in the side of the chamber 24.

The supply and return lines 32 and 34 are connected to a source 36 of pressurized hydraulic fluid by way of a duplex rotary distributing valve 38 continuously driven by a prime mover 40 such as a power take-off of the diesel engine which also drives the railroad car 16. Similarly, the other hydraulic piston 22 is interconnected by way of the supply and return lines 42 and 44 with the hydraulic fluid source 36 by way of a respective separate but preferably identical duplex rotary distributing valve 46 continuously driven preferably by the same prime mover 40.

The hydraulic pressure source 36, per se, is entirely conventional and typically includes, as separate component parts, a sump or hydraulic fluid reservoir to which the return line 34 and 44 would lead, and a pump such as a gear-type pump which draws hydraulic fluid from the sump and provides pressurized hydraulic fluid at the outlet which would be interconnected with the supply lines 32 and 42 in FIG. 1. In addition, within the hydraulic source 36, there normally is some means of pressure regulation or safety release with bypass lines between the outlet of the pump and the sump. All of these source components are strictly conventional parts of known hydraulic systems which are used in widely varying applications. If desired, however, the same prime mover 40 can be used to power the pump (not shown) in the hydraulic source 36.

The rotary distributing valve 46 is shown in greater detail in FIGS. 2–7. As revealed by FIGS. 2, 3, and 4, the rotary valve 46 comprises an internal, ported cylindrical spool 48 received in a tubular, ported cylindrical shell 50 and journaled for rotation therein by means of end ball bearing assemblies 52 and 54. An external drive shaft 56, is coaxially fixed to the end of the spool 48 to rotate the spool 48 within the shell 50. The drive shaft 56 and the spool 48 are preferably formed integrally as a single element. A plurality of lubrication annuli 58 form annular fluid reservoirs for lubricating the closely dimensioned mating surfaces of the spool 48 and shell 50. The lubricant is typically the hydraulic fluid. The spool 48 has formed therein, either by machining or casting, a pair of axially displaced throughports 60 and 62 which in the preferred embodiment are centered on parallel diameters of the spool 48 and comprise cylindrical passages through the spool 48. The throughports 60 and 62 are more clearly shown in the detailed view of the spool 48 without the shell 50 in FIG. 7.

Figure 3:
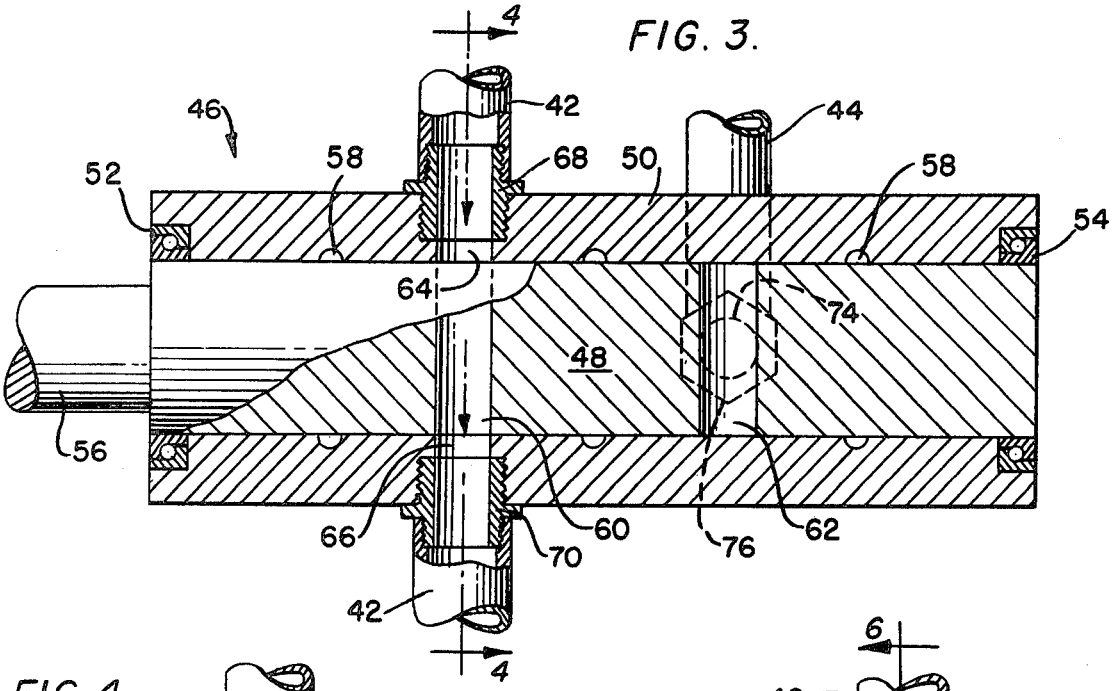
FIG. 3 is a cross-sectional view of the rotary valve taken along the lines 3—3 of FIG. 2.
Figure 4:
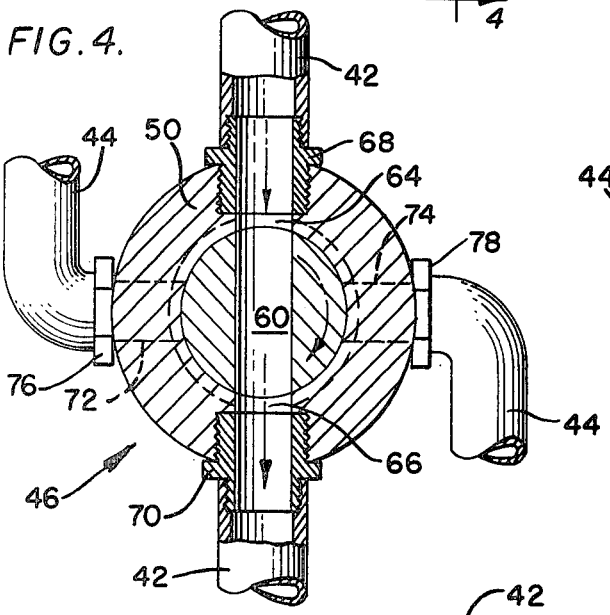
FIG. 4 is a cross-sectional view of the rotary valve taken along lines 4—4 of FIG. 3.

The shell 50 (FIGS. 2–4) has a pair of aligned openings 64 and 66 with threaded counterbores which receive respective threaded fittings 68 and 70 to which the threaded ends of the supply line 42 are connected. The shell openings 64 and 66 are aligned along a diameter of the shell 50 and are axially positioned and sized such that the openings 64 and 66 register with the throughport 60 whenever the spool member 48 is properly oriented as shown in FIGS. 3 and 4.

Figure 5:
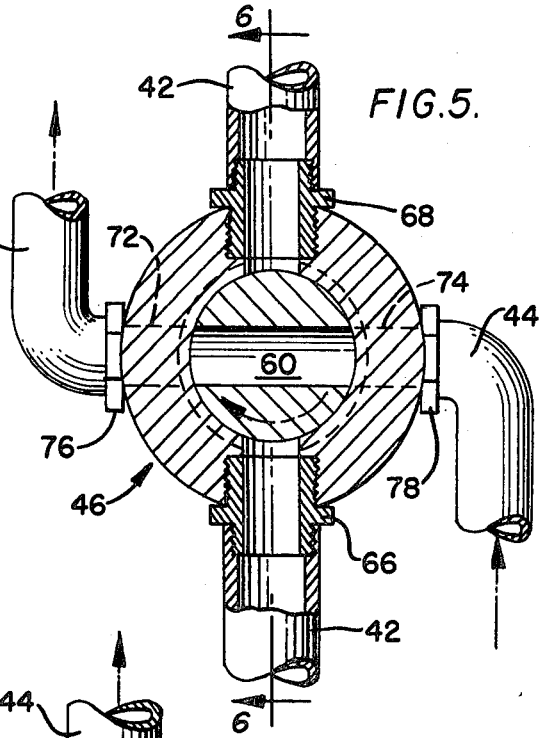
FIG. 5 is a view of the rotary valve identical to that in FIG. 4 except for a 90° rotation of the spool member.
Figure 6:
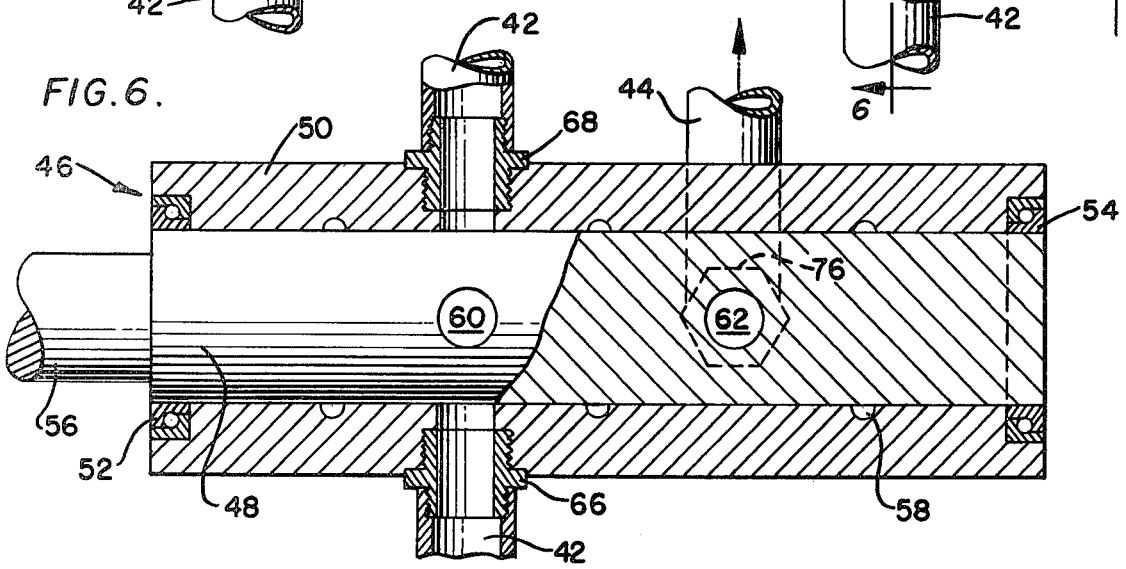
FIG. 6 is a cross-sectional view of the rotary valve taken along lines 6—6 of FIG. 5.
Figure 7:
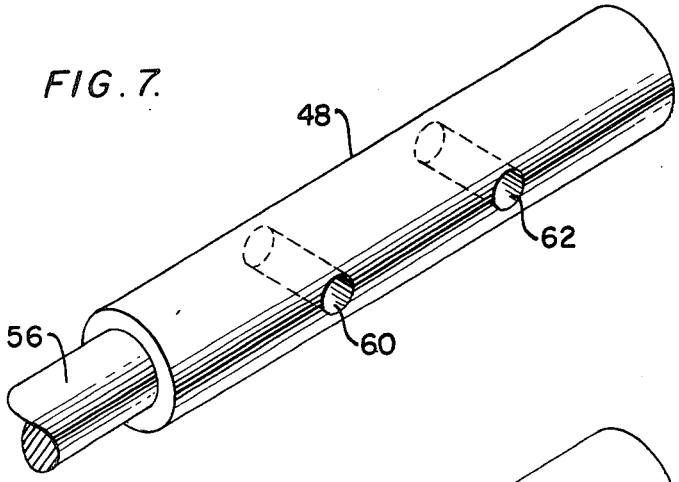
FIG. 7 is a detailed isometric view of the spool of the rotary valve of FIGS. 2 through 6.

A similar set of aligned openings 72 and 74 in the shell 50 is used for the return line 44. The counterbored openings 72 and 74 (shown by dashed lines in FIGS. 4 and 5) receive respective fittings 76 and 78 to which the threaded ends of the return line are attached. The aligned openings 72 and 74 for the return line are sized and spaced to register with the throughport 62 and are centered on a diameter of the shell 50 which is rotated 90° with respect to the diameter on which the aligned openings 64 and 66 for the supply line lie. Thus, when the spool member is rotated 90° as shown in FIG. 5, the throughport 60 is reoriented transversely with respect to the supply line 42 thus interrupting the supply of pressurized fluid while, as shown in FIG. 6, the parallel throughport 62 is in registration with the openings 72 and 74, thus opening the return line 44 to allow hydraulic fluid to be removed from the chamber (not shown) of the hydraulic piston 22 in FIG. 1.

In operation, the connections between the fluid supply and the return lines 32, 42, and 34, 44, respectively, are continuously altered by rotation of the spools in the rotary valves 38 and 46 of FIG. 1 thus alternatingly pressurizing and depressurizing the single-acting hydraulic pistons 20 and 22 to oscillate the tamper arms 10 and 12 at the same frequency. The phase relationship between the oscillation of the respective arms 10 and 12 can be altered by changing the relative effective orientation of the spools of the rotary valves 38 and 46 by the desired phase angle. While the spool member makes a complete revolution, the supply line is opened twice and closed twice while the return line is open thus accounting for two full reciprocations of the pistons 20 and 22 per rotation of the valves 38 and 46.

Figure 8:
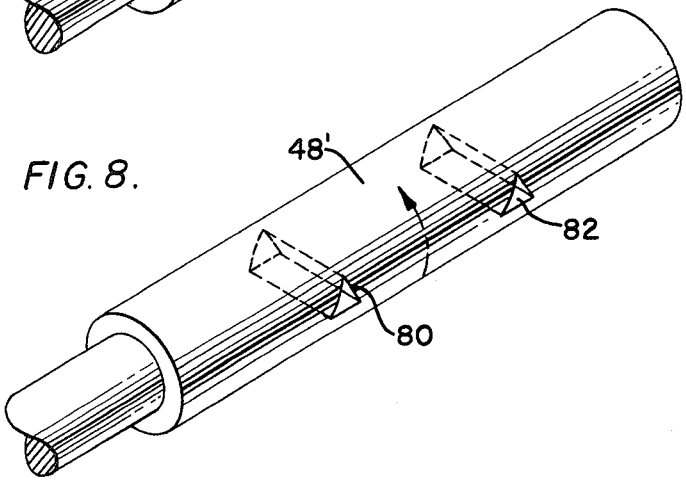
FIG. 8 is an isometric detail view of an alternate embodiment of the throughports in the spool.
Figure 8A:
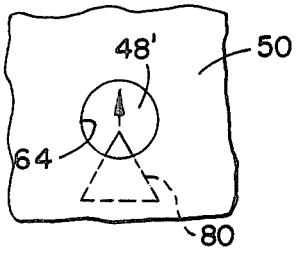
FIG. 8A is a fragmentary schematic view of the relationship between the triangular throughport of FIG. 8 and the opening in the shell of the rotary valve.

An alternate embodiment of the invention is shown in FIG. 8 in which shaped parallel throughports 80 and 82 have triangular cross-sections. As schematically indicated in FIG. 8A, as the spool 48′ rotates the throughport 80 into initial registration with the opening 64 in the shell 50, the tapered part of the opening is first encountered as the spool rotates allowing the passage between the aligned shell ports 64 and 66 (FIG. 3) to be more gradually opened than in the case with the cylindrical throughports. In the embodiment of FIG. 8 one side of the triangular cross-section is designed to be roughly parallel to the axis of rotation such that as the spool 48′ continues to rotate, the passage will be abruptly interrupted after it has been gradually opened. The principle of specifically designing the cross-sectional shape of the throughport or of the opening itself to affect the rate of opening or closing of the fluid passage can be implemented in many different ways as shown in FIGS. 9–12.

Figure 9:
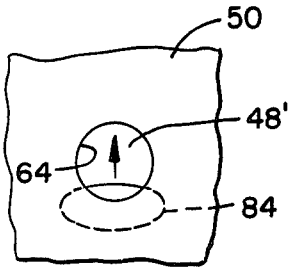
FIGS. 9 through 12 are similar views of the relationships between configurations of throughports in the spool member and openings in the shell of the rotary valve.
Figure 10:
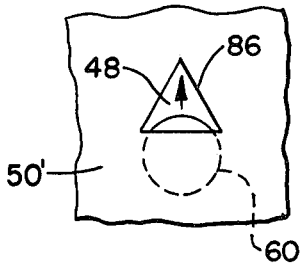
Figure 11:
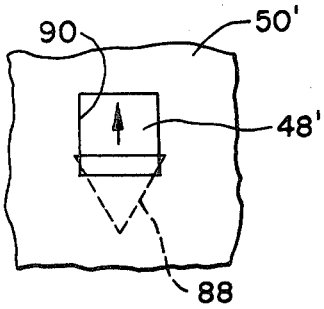
Figure 12:
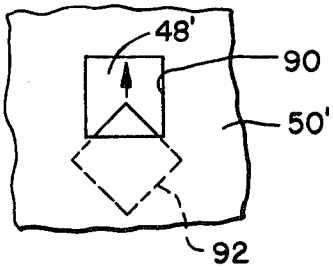

FIG. 9 illustrates throughport 84 with an ellipsoidal cross-section in a modified spool 48′ coming into registry with a cylindrical opening. A chordal cylindrical throughport would also give an ellipsoidal opening on the spool. FIG. 10 shows the cylindrical throughport 60 of the first embodiment coming into registry with a triangular opening 86 in a modified shell 50′. FIG. 11 illustrates a triangular throughport 88 formed in the spool 48′ coming into registry with a square opening 90 in the shell 50′. FIG. 12 shows a throughport 92 with a diamond-shaped cross section coming into registration with a square opening 90 in the shell 50′. This last embodiment would result in a gradual opening and closing of the fluid passage. Of course, the diamond-shaped cross section could be approximated by an ellipse whose minor axis is roughly parallel to the axis of rotation of the spool 48′.

A tamping machine constructed according to the invention used hydraulic pistons with a stroke of 3/16 of an inch and produced 2600 vibrations per minute. There is no problem, of course, in stopping the vibratory drive mechanism after each squeeze cycle is completed while moving the arms to the next tie. Intermittent stopping can be accomplished by inserting a separate manual valve in the supply lines leading to the rotary distributing valves or by temporarily disengaging the rotary valves (spools) from the prime mover. Unlike the mechanical vibratory fly-wheel tamper drives in the prior art, the vibration rate of the hydraulic drive of the invention can be varied by simply varying the rotational rate of the rotary valve to accommodate a preferred range of 0–5000 vibrations per minute.

The above-described embodiments are intended to be illustrative, rather than restrictive, the full scope of the invention being indicated and defined by the appended claims, which are intended to embrace any and all other equivalents, variations and modifications thereto to which the claims apply.

What is claimed is:

1. A vibratory drive mechanism for an oscillating tool, comprising: a single-acting hydraulic piston assembly having a ported pressure chamber and a reciprocating output member adapted to be operatively connected to vibrate the tool, a rotary distributing valve, fluid supply, and separate return line means connecting said piston pressure chamber via said rotary valve to a source of pressurized hydraulic fluid, said rotary valve including a ported cylindrical shell member having a first pair of openings connected with said supply line means and a second pair of openings connected with said return line means and axially displaced from said first pair of openings, a ported cylindrical spool member coaxially received in said shell for continuous sealing rotation therein having first and second axially displaced throughports positioned for alternate registration, respectively, with said first and second pairs of shell member openings, and drive means for imparting continuous rotation to said spool member in said shell member.

2. The vibratory drive mechanism of claim 1, wherein said pairs of openings are aligned on respective diameters of said shell member and said throughports are defined on respective diameters of said spool member.

3. The vibratory drive mechanism of claim 2, wherein said spool member throughports are parallel to each other and the diameters on which said first and second pairs of shell member openings are aligned are angularly displaced about the axis of said shell.

4. The vibratory drive mechanism of claim 3, wherein said diameters on which said first and second pairs of openings are aligned are rotated through an angle of about 90° relative to each other.

5. The vibratory drive mechanism of claim 1, wherein one of said throughports has a cross-section which is elongated in a direction which is approximately perpendicular to the axis of rotation of said spool member to determine the rate of opening or closing of the rotary valve.

6. The vibratory drive mechanism of claim 1, wherein one of said throughports has a cross section which is elongated in a direction approximately parallel to the axis of rotation of said spool member to determine the rate of opening or closing of the rotary valve.

7. A tandem vibratory drive mechanism for a pair of cooperatively oscillating tools, comprising: first and second hydraulic piston assemblies having output means operatively connected to vibrate the respective tools and having respective ported pressure chambers, a separate rotary valve means for controlling the operation of the piston assemblies respectively, first and second pairs of fluid supply lines and separate fluid return lines connecting the respective pressure chambers of said piston assemblies to a source of pressurized hydraulic fluid via the respective one of said rotary valve means, each said rotary valve means including a ported cylindrical shell member having first and second pairs of openings axially displaced from each other and connected respectively with said supply and return lines and an internal ported cylindrical spool member coaxially received for continuous sealing rotation within said shell and having formed therein first and second throughports axially displaced from each other and positioned for respective alternate registration with said first and second pairs of openings, and drive means for imparting continuous rotation to each spool member of each rotary valve means.

8. The tandem vibratory drive mechanism of claim 7, wherein said pairs of openings are aligned on respective diameters of said shell member and said throughports are defined on respective diameters of said spool member.

9. The tandem vibratory drive mechanism of claim 7, further comprising means for adjusting the phase of oscillation of one of said rotary valve means with respect to the other.

10. The tandem vibratory drive mechanism of claim 8, wherein said throughports are parallel and said first and second pairs of openings in said shell member are rotated relative to each other about the axis of said shell member.

11. The tandem vibratory drive mechanism of claim 10, wherein said first and second pairs of openings in said shell member are rotated about 90° with respect to each other about the shell member axis.

12. The tandem vibratory drive mechanism of claim 7, wherein one of said throughports has a cross section which is elongated in a direction approximately perpendicular to the axis of rotation of said spool member to determine the rate of opening or closing of said valve means.

13. The tandem vibratory drive mechanism of claim 7, wherein one of said throughports has a cross section which is elongated in a direction approximately parallel to the axis of rotation of the spool member to determine the rate of opening or closing of said valve means.

* * * * *

UNITED STATES PATENT AND TRADEMARK OFFICE

CERTIFICATE OF CORRECTION

PATENT NO. : 4,092,903

DATED : June 6, 1978

INVENTOR(S) : FRANZ ALLMER

It is certified that error appears in the above-identified patent and that said Letters Patent are hereby corrected as shown below:

In the Abstract, line 2, change "hyraulic" to --hydraulic--.

Column 5, line 64, after "supply", insert --line means-- and after "separate", insert --fluid--.

Signed and Sealed this

*Seventh* Day of *November 1978*

[SEAL]

*Attest:*

RUTH C. MASON
*Attesting Officer*

DONALD W. BANNER
*Commissioner of Patents and Trademarks*